US012599813B2

(12) United States Patent
Orand et al.

(10) Patent No.: US 12,599,813 B2
(45) Date of Patent: Apr. 14, 2026

(54) SWIM CAP

(71) Applicant: NIKE, Inc., Beaverton, OR (US)

(72) Inventors: Austin J. Orand, Portland, OR (US); Kyle Schepke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/523,377

(22) Filed: Nov. 29, 2023

(65) Prior Publication Data

US 2024/0173594 A1 May 30, 2024

Related U.S. Application Data

(60) Provisional application No. 63/428,809, filed on Nov. 30, 2022.

(51) Int. Cl.

| | |
|---|---|
| ***A63B 33/00*** | (2006.01) |
| *A42B 1/019* | (2021.01) |
| *A42B 1/04* | (2021.01) |
| *A42B 1/041* | (2021.01) |
| *A42B 1/12* | (2006.01) |

(52) U.S. Cl.

CPC ..... *A63B 33/00* (2013.01); *A42B 1/019* (2021.01); *A42B 1/04* (2013.01); *A42B 1/041* (2013.01); *A42B 1/12* (2013.01)

(58) Field of Classification Search

CPC ..... A42B 1/04; A42B 1/041; A42B 1/019; A42B 1/12; A63B 33/00

USPC ..... 2/68

See application file for complete search history.

(56) References Cited

U.S. PATENT DOCUMENTS 1,516,380 A * 11/1924 Eaton ..... A42B 1/12 2/68
1,746,427 A * 2/1930 Howland ..... A42B 1/12 36/8.1
1,746,477 A * 2/1930 Howland ..... A42B 1/12 36/8.1

(Continued)

FOREIGN PATENT DOCUMENTS

GB 0767201 A 1/1957
GB 1169344 A 11/1969

OTHER PUBLICATIONS

International Search Report and Written Opinion received for PCT Patent Application No. PCT/US2023/081943, mailed on Mar. 20, 2024, 11 pages.

*Primary Examiner* — Khaled Annis
*Assistant Examiner* — Dakota Marin
(74) *Attorney, Agent, or Firm* — Shook, Hardy & Bacon L.L.P.

(57) ABSTRACT

This disclosure relates to a swim cap with a wall that can include a surface with a higher coefficient of friction (e.g., higher than conventional swim caps and/or higher than other surfaces of the swim cap). The surface finish can be positioned at various locations of an inner face of the swim cap, and in some examples, the surface finish is positioned near the edge of the swim cap (e.g., the terminal edge forming a perimeter around the head opening of the swim cap). In some examples, the band extending around the edge can be associated with a thicker wall of material, which can increase the modulus of elasticity and a tightness of the fit of the swim cap. The swim cap can include various materials, and in some examples, the swim cap comprises silicone.

14 Claims, 9 Drawing Sheets

(56) References Cited

U.S. PATENT DOCUMENTS 1,771,178 A * 7/1930 Howland ..... A42B 1/12 36/8.1
2,131,344 A * 9/1938 Crowley ..... A42B 1/12 D2/867
2,285,660 A * 6/1942 Howland ..... A42B 1/12 248/363
2,353,403 A * 7/1944 Howland ..... A42B 1/12 2/68
2,505,359 A * 4/1950 Hurt ..... A42B 1/12 2/68
2,605,504 A 8/1952 Feldman
2,730,720 A * 1/1956 Saunders ..... A42B 1/12 2/68
3,113,319 A * 12/1963 Vail ..... A42B 1/12 2/68
3,447,164 A * 6/1969 Greenhouse ..... A42B 1/12 2/68
3,793,110 A * 2/1974 Saunders ..... B29C 66/004 156/289
3,852,823 A * 12/1974 Jones ..... A42B 1/12 428/41.9
4,011,598 A * 3/1977 Sherr ..... A42B 1/12 2/68
4,134,155 A * 1/1979 Robertson ..... A63B 71/10 2/412
5,095,545 A * 3/1992 Lane ..... A42B 1/12 2/413
6,052,825 A * 4/2000 Dodd ..... A42B 1/12 2/68
6,966,068 B2 * 11/2005 Johnson ..... A42B 1/12 2/200.2
7,472,428 B2 * 1/2009 Van Atta ..... A42B 1/12 2/200.2
10,869,516 B2 * 12/2020 Sokoloff ..... A42B 1/12
11,110,320 B2 * 9/2021 Bono ..... A42B 1/12
11,351,422 B2 * 6/2022 Yeomans ..... A42B 1/12
11,571,035 B2 * 2/2023 Bonhomme ..... A42C 1/00
2003/0131861 A1 * 7/2003 Prestia ..... A41G 3/0008 132/53
2009/0038048 A1 * 2/2009 Thompson ..... A42B 1/12 2/68
2010/0192273 A1 * 8/2010 Dodd ..... A42B 1/12 2/68
2014/0109281 A1 * 4/2014 Waller ..... A42B 1/12 2/68
2015/0000002 A1 * 1/2015 Brown ..... A42B 1/12 2/68
2015/0157077 A1 * 6/2015 Stricker, Jr. ..... A42B 1/08 2/414
2015/0335086 A1 * 11/2015 Murphy ..... A42B 1/041 2/171
2017/0020221 A1 * 1/2017 Harsh ..... A42B 1/041
2019/0090561 A1 * 3/2019 Brandt ..... A42B 1/046
2019/0232114 A1 * 8/2019 Burns ..... A42B 1/08
2019/0380414 A1 * 12/2019 Hinds ..... A42C 5/02
2020/0404999 A1 * 12/2020 Burgess ..... A42B 1/019
2023/0371620 A1 * 11/2023 Murphy ..... A41D 27/10
2024/0058653 A1 * 2/2024 Williams ..... A42B 1/12

* cited by examiner

SWIM CAP

CROSS-REFERENCE TO RELATED APPLICATIONS

This application claims priority to U.S. Provisional Application No. 63/428,809 which was filed on Nov. 30, 2022 and is incorporated herein by reference in its entirety.

BACKGROUND

Swim caps are often worn during swimming competitions, training, or exercise activities, such as to affect hydrodynamics. Swim caps can include a latex composition, and in some examples, swim caps are constructed from relatively flat mold or press, such as with a relatively broad and flat mold core.

DETAILED DESCRIPTION OF DRAWINGS

The present systems and methods for a swim cap are described in detail below with reference to these figures.

DETAILED DESCRIPTION

Figure 1:
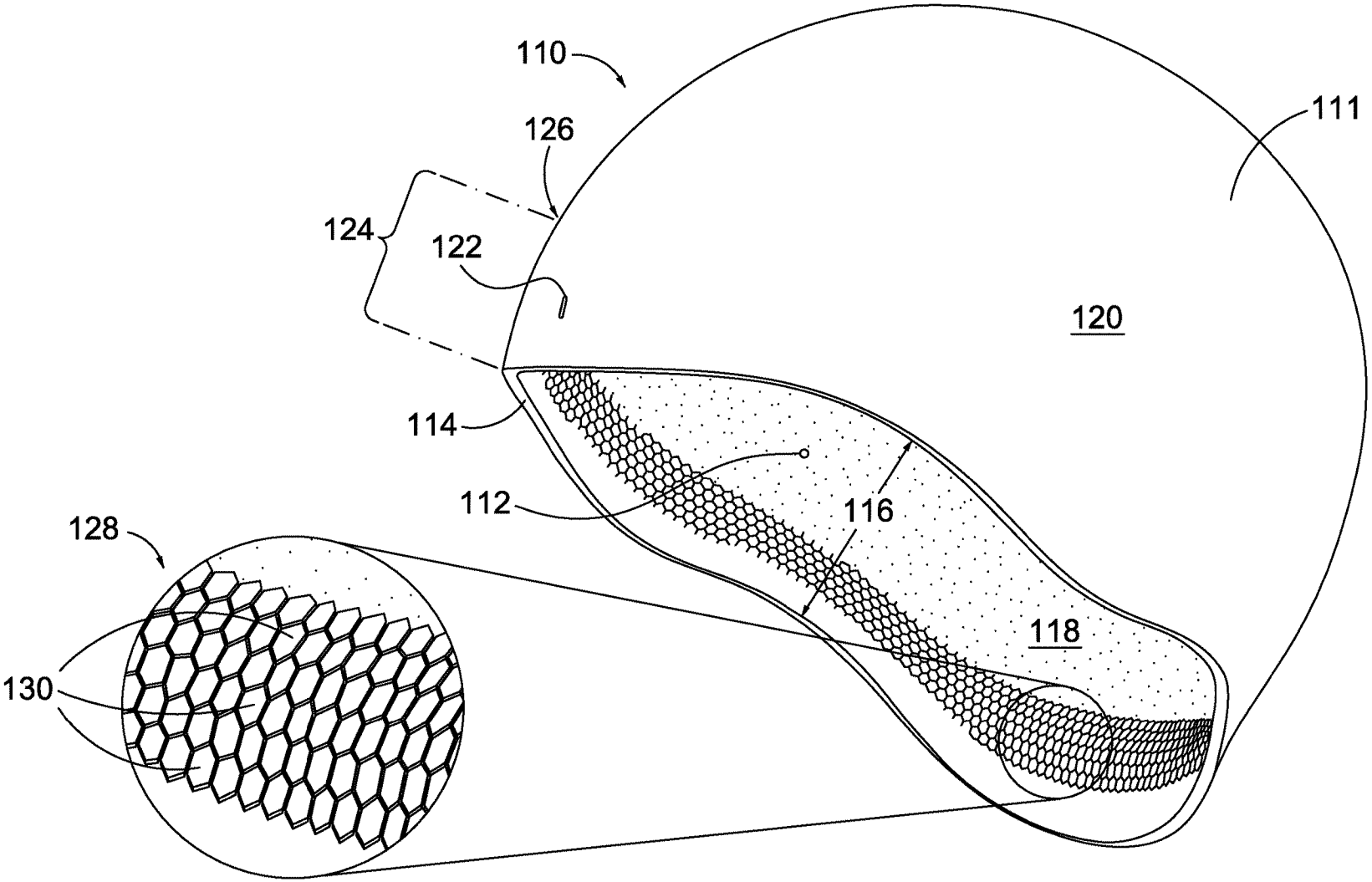
FIG. 1 depicts an example swim cap, in accordance with examples of this disclosure.

This detailed description is related to a swim cap that more securely fits to an athlete's head. For example, an inward facing surface of the swim cap can include a surface finish that is configured to be less prone to slipping off of the athlete's head. In some examples, the surface finish can be associated with a higher coefficient of friction (e.g., higher than conventional swim caps and/or higher than other surfaces of the swim cap). The surface finish can be positioned at various locations of the inward facing surface, and in some examples, the surface finish is positioned near the edge of the swim cap (e.g., the terminal edge forming a perimeter around the head opening of the swim cap). For example, the surface finish can be at one or more positions along a band that extends around the edge of the swim cap. In some examples, the band extending around the edge can be associated with a thicker wall of material, which can increase the modulus of elasticity and a tightness of the fit of the swim cap.

Some conventional swim caps can be prone to inadvertently slip off of the athlete's head (e.g., due to hydrodynamic drag). In addition, some conventional swim caps can present challenges for athletes with more hair on their head (e.g., longer hair or thicker hair), such as by being uncomfortable and/or failing to provide a volume large enough and/or shaped to accommodate the hair. Further, some conventional swim caps can be less adaptable to fit a variety of different head shapes. In addition, some materials used to form swim caps can be prone to tearing (or failing in other ways) during manufacturing or in use. Also, some materials (e.g., latex) can be more allergenic, which can cause irritation and discomfort to wearers.

As such, in contrast to conventional swim caps, subject matter of the present disclosure can be less likely to slip off (e.g., based on the surface finish with the higher coefficient or friction and/or the thicker band with higher modulus of elasticity). In some examples, the other portions of the swim cap (e.g., other than the band) can include a thinner wall, which can be associated with a lower modulus of elasticity for easier stretching to accommodate hair and/or various head shapes. In at least some examples, the swim cap can operate as a base swim cap that is configured to be worn underneath a second swim cap (e.g., underneath an outer swim cap), and the swim cap can include one or more surface finishes on the outer surface configured to improve fit and operability with the outer swim cap.

Some examples of the present disclosure are directed to subject matter for manufacturing a swim cap, including a swim cap with a domal wall. In some instances, manufacturing a swim cap with a domal wall can include different equipment and/or processes, as compared to a swim cap with more planar or flat walls. In some examples, a mold for forming a swim cap with a domal wall can include a core (e.g., a domal core) and a cavity (e.g., a two-part cavity that can selectively open and close around the core). In addition, surface finishes associated with the swim cap can be formed by configuring the surfaces of the cavity and/or the core. For example, if a higher-gloss surface is desired, then a surface of the core and/or the cavity can be configured with a smoother, higher-gloss surface (e.g., as compared to a matte surface of the swim cap that can be formed via a rougher surface of the cavity or the core). In addition, if a textured surface is desired, then the surface of the cavity and/or core can be textured or include a negative relief of the texture. In some examples, the mold (e.g., with the domal core) can be used to manufacture a silicone swim cap (e.g., by injection molding), including the desired surface finishes (e.g., higher grip surface in the inner face). In contrast to conventional approaches, the mold with the domal core can allow for manufacturing processes that are less likely to cause the swim cap to tear (e.g., during manufacturing). In addition, the silicone-based swim cap can be more hypoallergenic (e.g., as compared to latex in some instances). In some example, the silicone-based swim cap can provide a desired amount of elasticity (e.g., for conforming to a wearer's head shape, hair, etc.), while also providing durability and other desired properties.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. If a definition of "about" is necessary for interpreting a term of this disclosure, "about" refers to +/−10% of a given value.

The terms "comprising," "including," and "having" are inclusive and therefore specify the presence of stated materials, features, steps, operations, elements, or components, but do not preclude the presence or addition of one or more other materials, features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The phrases "formed from" and "formed of" are also intended throughout this disclosure and the accompanying claims to be inclusive, and to specify the presence of stated materials, features, steps, operations, elements, or components, but to not preclude the presence or addition of one or more other materials, features, steps, operations, elements, or components unless otherwise indicated.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the inventive embodiments described in this Specification, and as further defined by the claims.

In some examples, this description can refer to modulus of elasticity and coefficient of friction. These properties can be measured using one or more techniques that known to ordinary skilled artisans based on the context of this disclosure.

In some examples, modulus of elasticity includes resistance to being elastically deformed (e.g., non-permanently) when a stress or force is applied. A lower modulus of elasticity (e.g., relative as between two items) indicates a lower resistance to be elastically deformed when subjected to a given stress or force, and a higher modulus of elasticity (e.g., relative as between two items) indicates a higher resistance to being elastically deformed when subjected to the given stress or force. In some examples, modulus of elasticity can be determined for an area or portion of a swim cap by connecting the area or portion to a gripping device (e.g., via a clamp), applying a pulling force at a given unit measurement, and determining the degree of stretch (e.g., percentage of elongation relative to the resting state). The modulus of elasticity of different areas can be compared by subjecting each area to the same pulling force and comparing the degrees of stretch.

In some examples, coefficient of friction is a value quantifying resistance to motion between two objects, such as a surface of the swim cap and human skin. Static friction can describe the amount of force required to move the swim cap relative to the human skin, when the swim cap is initially at rest relative to the human skin. Kinetic friction can describe the amount of force required to move the swim cap relative to human skin, when the swim cap is already in motion relative to the human skin. A lower coefficient of friction or static friction or kinetic friction (e.g., relative as between two items) indicates a lower amount of force is necessary to move the swim cap relative to the human skin. In some examples, a higher coefficient of friction or static friction or kinetic friction (between a swim cap and human skin) can translate to a swim cap that is less likely to slip off a wearer. In some examples, coefficient of friction is a value quantifying resistance to motion between a surface of the swim cap (e.g., an outer facing surface) and water.

The terms "external" and "internal" as used herein are relative terms such that a layer that is external is positioned external to one or more internal layers, and a layer that is internal is positioned internal to one or more external layers. The term "innermost-facing surface" when used with respect to the support garment means a layer that is positioned closest to a body surface of a wearer compared to other layers of the support garment. The term "outermost-facing surface" when used with respect to the support garment means a layer that is positioned closest to the external environment with respect to other layers of the support garment. Positional terms such as "medial" and "lateral" are used in the customary anatomical sense.

As used in this disclosure, "domal" can indicate a structure or wall having a portion of which is dome-like. For example, an inner face can include a concave contour and the outer face can include a convex contour. In some examples, a domal wall can include at least some portions that are relatively symmetrical (e.g., similar contours or degree of convexity or concavity), and the wall can also be asymmetrical in some respects and still be considered dome-like. A domal wall is not necessarily hemispherical, but it can be hemispherical. In some examples, the contour of the concave first face can correspond to an anatomical region of a wearer. Various aspects are described below with reference to the drawings. However, examples of the present disclosure are not limited to those illustrated in the drawings or explicitly described below. It also should be understood that the drawings are not necessarily to scale, and in certain instances details may have been omitted (e.g., for ease of illustration).

Referring now to FIG. 1, FIG. 1 depicts an example swim cap 110 that includes a wall 111 (e.g., a domal wall) that at least partially encloses a volume 112 for containing a portion of a wearer's head. The wall 111 can compositionally comprise various elastic materials, such as silicone or other elastomeric, hypoallergenic materials. As used herein, an elastic material can resiliently stretch (e.g., under tension) from its original length and to substantially return to its original length (e.g., when the tension force is removed).

In addition, the swim cap 110 includes an edge 114 (e.g., terminal edge of the domal wall 111) that forms a perimeter around an opening 116 for donning and doffing the swim cap 110. The swim cap 110 also includes an inner face 118 that faces towards the head when the swim cap 110 is worn and an outer face 120 that faces away from the head when the swim cap 110 is worn. In some examples, the swim cap 110 can include a band 122 circumferentially extending along the edge 114 and around the periphery of the opening 116, and the band 122 can comprise a width 124 extending from the edge 114 to an opposing point 126 spaced apart from the edge 114. In some examples, the opposing point 126 can be associated with a change from properties associated with the band 122 to properties associated with other portions of the swim cap 110 positioned further away from the edge 114. That is, a position associated with the opposing point 126 can be based on (e.g., located at) a point at which properties associated with the cap transition from properties associated with the band 122 to a different set of properties. In some examples, one or more properties that can change near the opposing point 126 can include a wall thickness (e.g., thickness of the wall 111) and a surface finish on the inner face 118 and/or on the outer face 120.

In at least some examples of the present disclosure, the inner face 118 can include a surface finish configured to be less prone to slipping off of the athlete's head. As used herein, surface finish can refer to a surface texture, a material deposit applied to a surface, or a combination thereof. A surface texture can include a surface relief of positive material and negative spaces molded into the surface during manufacturing of the surface. A surface texture an also include a surface relief formed via additive manufacturing processes and/or subtractive manufacturing processes. In some examples, the surface finish can be associated with a higher coefficient of friction relative to human skin (e.g., higher than conventional swim caps and/or higher than other surfaces of the swim cap). The surface finish can be positioned at various locations of the inner face 118, and in some examples, the surface finish is positioned near the edge 114 of the swim cap 110. For example, the surface finish can be at one or more positions along the band 122. The surface finish can include various properties. In some examples, the surface finish can comprise a plurality of raised protuberances that protrude from the inner face 118 towards the volume 112 and/or a series of grooves or voids or interstitial spaces that form a pattern of positive-relief material portions. The protuberances and the positive-relief material portion can include nodules, bumps, ribs, ridges, polygonal shapes, or other shapes. For example, the enlarged view 128 depicts a plurality of raised nodules 130.

In some examples, the surface finish on the inner face 118 can include other or different properties. For example, referring to FIG. 2, a swim cap 210 is depicted with at least some properties similar to the swim cap 110, and for brevity, those same properties are not described again (but it is understood that the same description can apply to the swim cap 210). In accordance with some examples, the swim cap 210 can include one or more surface finishes associated with the inner face 218. For example, the enlarged view 228 depicts an example surface finish, which can include a combination of matte portions 230 and high-gloss portions 232.

In examples, the combination of matte portions 230 with the high-gloss portions 232 can contribute to, or impart, a higher coefficient of friction (e.g., as between a portion of the swim cap and human skin). In at least some examples, the terms "matte," "low-gloss" and "high-gloss" (and "lower-gloss" and "higher-gloss") refer to relative degrees as between the portions 230 and 232, or more generally, between surface finishes or between different aspects of one surface finish. Surface finishes with "lower-gloss" are more matte or duller, and surface finishes with "higher-gloss" are less matte or less dull or have a higher luster. For example, the portion 230 can be more matte and lower gloss or less high-gloss than the portion 232, and the portion 232 can be more high-gloss or higher gloss and less matte than the portion 230. In some examples, a higher gloss surface of the swim cap can be associated with a higher coefficient of friction as against human skin and as compared to a lower gloss surface, which can be associated with a lower coefficient of friction. For instance, the portions 232 in FIG. 2 can include grippy protuberances that decrease the likelihood of the swim cap slipping off the wearer.

In at least some examples, a gloss of a surface can be determined using a glossmeter to measure specular reflection by projecting a light beam at a fixed intensity and angle onto the surface and measuring the amount of reflected light at an equal but opposite angle. In some examples, a surface can be lower gloss or higher gloss, as compared to another surface, by comparing the relative amounts of reflected light measured using a gloss meter. A surface that is associated with higher amounts of reflected light (as compared to a different surface) can be described as higher gloss or less matte, whereas the different surface that is associated with lower amounts of reflected light can be described as lower gloss or more matte or duller.

In at least some examples, the matte portions 230 and the high-gloss portions can comprise a repeating pattern. In at least some examples, the matte portions 230 can comprise a pattern of n-polygonal shapes that are spaced apart by recessed interstitial spaces of the high-gloss portion 232. In some examples, the high-gloss portion 232 can comprise a pattern of n-polygonal shapes that are spaced apart by recessed interstitial spaces of the matte portion 230.

Figure 2:
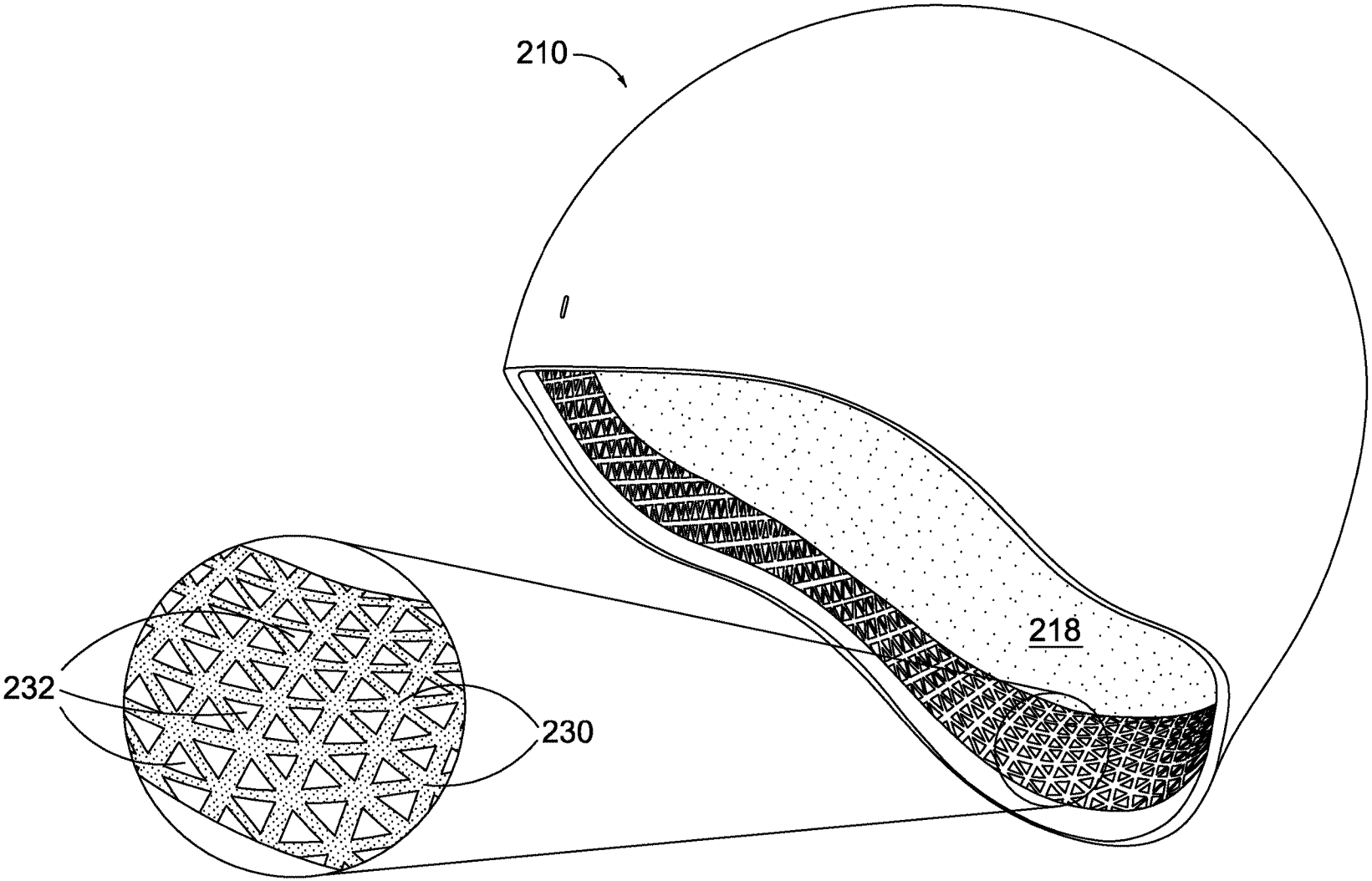
FIG. 2 depicts another example swim cap, in accordance with examples of this disclosure.

In FIG. 2, the surface finish includes a pattern of triangular high-gloss portions 232 that are separated by recessed interstitial spaces of the matte portions 230. These are just examples, and the pattern can include a variety of different shapes. In some examples, the recessed interstitial spaces have a strip-like form (e.g., relatively long and narrow where the length is longer than the width). In some examples, the strip-like forms can be relatively straight. In some examples, the strip-like form can be wavy. In some examples, the recessed interstitial spaces can have an irregular form (e.g., where the protuberances are not necessarily aligned in rows or a pattern). In some examples, the raised protuberances may be organized in a repeating pattern, or in other examples, the raised protuberances may be organized irregularly. In some examples, the surface finish comprises a plurality of high-gloss and low-gloss surfaces that are not raised or do not protrude.

Figure 3A:
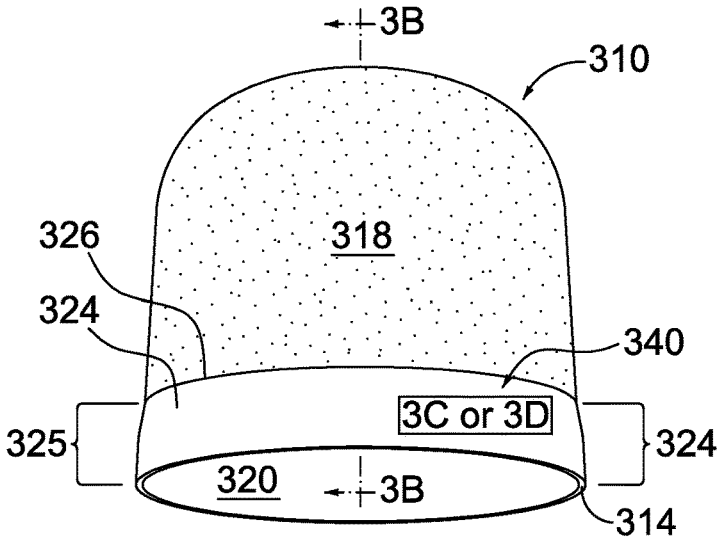
FIG. 3A depicts an inner face of another example swim cap, in accordance with examples of this disclosure.
Figure 3B:
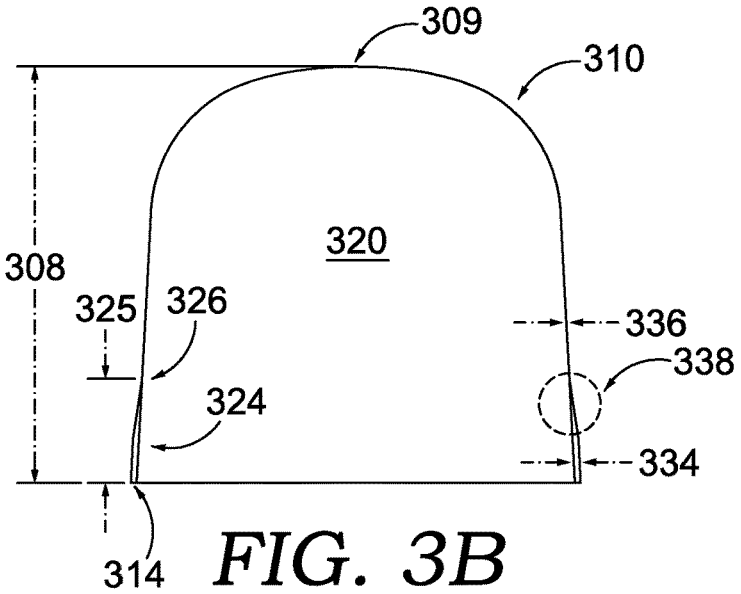
FIG. 3B depicts a cross section based on FIG. 3A, based on an example.

Referring now to FIGS. 3A and 3B, an example swim cap 310 is depicted, and the swim cap 310 is illustrated inside-out, such that the inner face 318 (e.g., configured to face towards the wearer) is facing outwards and the outer face 320 (e.g., configured to face away from the wearer) is facing inwards. In examples, the swim cap 310 can include at least some properties similar to the swim cap 110 and/or the swim cap 210, and for brevity, those same properties are not described again (but it is understood that the same description can apply to the swim cap 310).

In examples, the swim cap 310 can include a band 324 extending around the edge 314. In at least some examples, the band 324 can be associated with a thicker wall of material. For example, the band 324 can include a first thickness 334 that is thicker than other portions of the swim cap 310, which (as compared to the band 324) are spaced further away the edge 314, such as portions associated with second thickness 336. In some examples, the first thickness 334 can be in a range of about 1.5 mm to about 2.5 mm; or about 2.0 mm. In some examples, the second thickness 336 can be in a range of about 0.7 mm to about 1.5 mm.

In some examples, the band 324 and/or the swim cap 310 can include a tapered portion 338 that tapers in thickness as the wall of the swim cap 310 transitions from the first thickness 334 to the second thickness 336. In at least some examples, the band 324 can, based on the thicker wall, be associated with a higher modulus of elasticity, which can contribute to a more secure fit against the wearer's head and can decrease the likelihood of the swim cap 310 inadvertently slipping off (e.g., due to hydro dynamic drag).

Figure 3C:
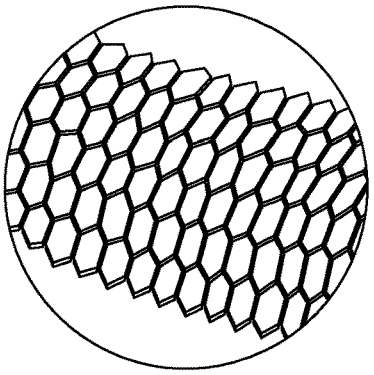
FIG. 3C depicts an example of a surface finish for the swim cap in FIG. 3A, based on one example.
Figure 3D:
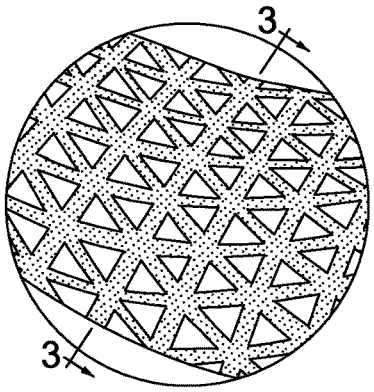
FIG. 3D depicts an example of another surface finish for the swim cap in FIG. 3A, based on another example.

In some examples, at least a portion of the inner face 318 comprises a matte surface finish, such as in the crown or apex portion of the cap. In examples, a matte finish can (as compared to a higher-gloss surface) be less likely to pull hair when the cap is being put on or taken off and/or when the cap is shifting on the wearer when in use. In other examples, at least a portion of the inner face comprises a higher gloss surface finish, such as where additional grip is desired (e.g., near the band 324). In some examples, the swim cap 310 can also include, on the inner face 318, one or more regions along the band 324 associated with a higher coefficient of friction (e.g., higher than conventional swim caps and/or higher than other surfaces of the swim cap). For example, the band 324 can include a first surface finish (e.g., FIG. 3C) similar to the surface finish in FIG. 1, a second surface finish (e.g., FIG. 3D) similar to the surface finish in FIG. 2, or a combination thereof. As such, in contrast to conventional swim caps, subject matter of the present disclosure can be less likely to slip off (e.g., based on the surface finish with the higher coefficient or friction and/or the thicker band 324 with higher modulus of elasticity).

The band 324 can comprise a width 325 (e.g., FIG. 3B) extending from the edge 314 to an opposing point 326 spaced apart from the edge 314. In some examples, the opposing point 326 can be associated with a change in properties associated with the band 324 to properties associated with other portions of the swim cap 310 positioned further away from the edge 314. That is, a position associated with the opposing point 326 can be based on (e.g., located at) a point at which properties associated with the cap 310 transition from properties associated with the band 324 to a different set of properties, such as wall thickness, surface finish, etc. In examples, the band 324 can include a width dimension 325 (e.g., from the edge 314 to the point 326) that is in a range from about 1.0 cm to about 6 cm, or from about 2 cm to about 5 cm, or from about 3 cm to about 4 cm. In some examples, the width dimension can include a dimension that is a ratio of the overall height 308 of the cap 310, which can be defined by a distance 308 between the edge 314 and the apex 309 of the crown of the swim cap 310. For instance, in some examples, the ratio of the width 325 to the overall height 308 can be in a range of about 1:3 to about 1:8. In some examples, the ratio of the width 325 to the height 308 is about 1:5.

In some examples, the width 325 can vary at different positions around the cap 310. For example, the front portion of the cap 310 can be associated with a first width 325, the side portions of the cap 310 can be associated with a second width 325, and the back portion of the cap 310 can be associated with a third width. In examples, at least one of the second width and the third width can be different than the first width. For example, the first width can be smaller than or larger than at least one of the second width and the third width.

As indicated above, the band 324 can be associated with the thickness 334 (e.g., wall thickness). In some examples, the band 324 can be associated with a plurality of wall thicknesses, such as where a surface finish includes a pattern of protuberances. For example, referring to FIGS. 3E and 3F, cross sectional views are depicted of different embodiments, taken along the cross-reference line 3-3 in FIG. 3D.

Figure 3F:
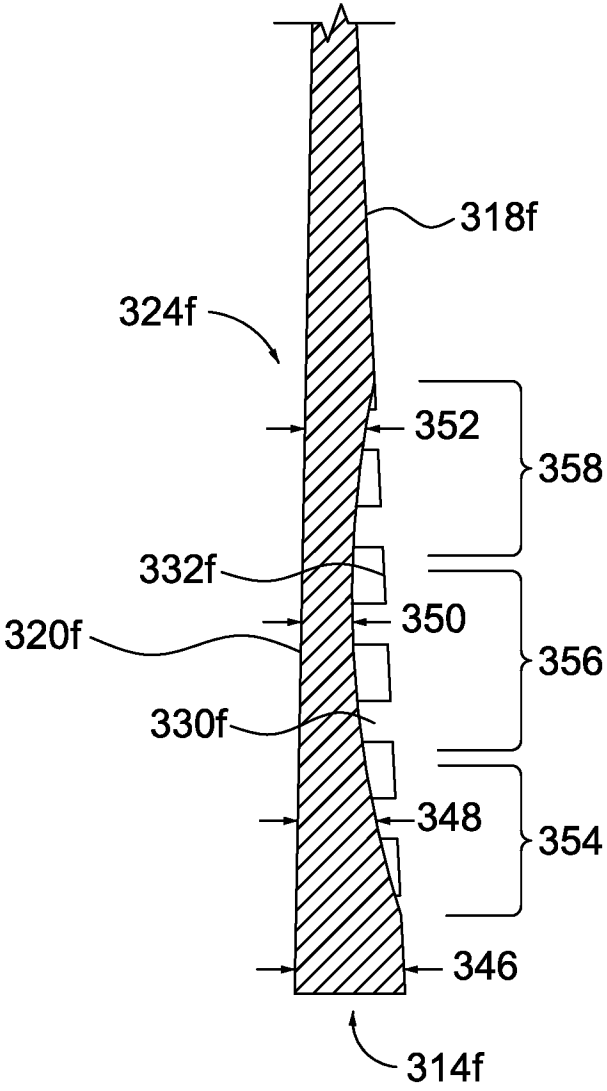
FIG. 3F depicts a cross section of the surface finish in FIG. 3D based on another example having a varied depth.
Figure 3E:
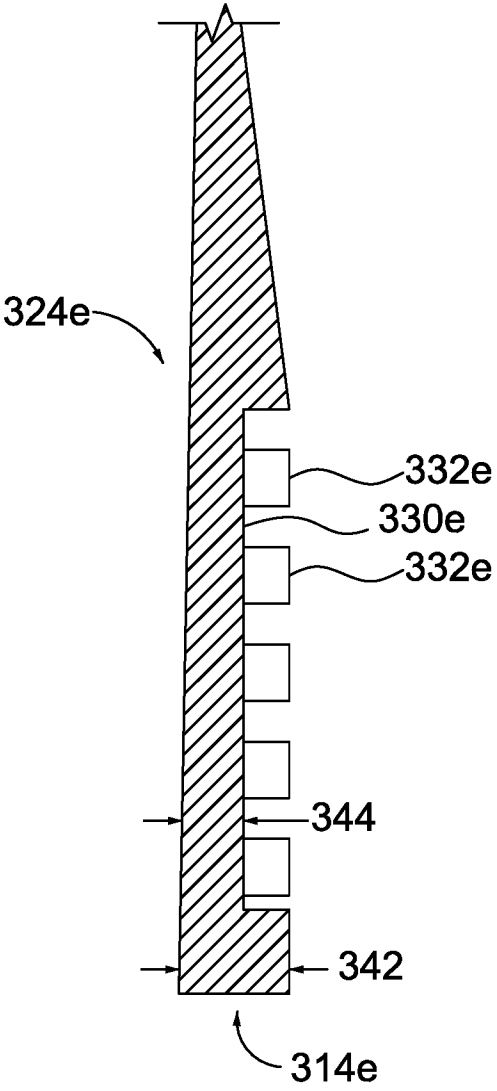
FIG. 3E depicts a cross section of the surface finish in FIG. 3D based on one example having a relatively constant depth.

Referring to FIG. 3E, the band **324*e* can be associated with protuberances (e.g. 332*e*) and interstitial spaces (e.g., 330*e*) between the protuberances 332*e*. In some examples, the band 324*e* can be associated with a first thickness 342, which is directly adjacent the edge 314*e*. In some examples, at least some of the protuberances 332*e* can also be associated with the first thickness 342. In addition, the interstitial spaces 330*e* can be associated with a second thickness 344. In some examples the interstitial spaces 330*e* can include a consistent depth as the interstitial spaces 330*e* are extend away from the edge 314*e***.

In some examples, referring to FIG. 3F, the band **324*f* can be associated with protuberances 332*f* and interstitial spaces 330*f* between the protuberances 332*f*. In some examples, the band 324*f* can be associated with a first thickness 346, which is directly adjacent the edge 314*f*. In some examples, at least some of the protuberances 332*f* can also be associated with the first thickness 346. In addition, the interstitial spaces 330*f* can include various depths (e.g., relative to the face 318), which can depend on a location of the interstitial space within the band 324*f*. In at least some examples, the interstitial spaces 330*f* can gradually transition from a shallower depth, which is closer to the edge 314*f*, to deeper depth that is farther from the edge 314*f*, and then gradually transition from the deeper depth to a shallower depth near the tapered portion 338. As such, a wall thickness associated with the interstitial spaces 330*f* can transition (e.g., gradually or step-like) from a larger thickness 348 closer to the edge 314*f*, to a smaller thickness 350 in a middle region of the band 324*f*, and back to a larger thickness 352 closer to the tapered portion 338*f***.

In other words, the distance between the outer face **320*f* and the recessed interstitial spaces 330*f* is smaller in the second area 356 than in the first area 354 or third area 358. Areas 354 and 358 can be similar such that the shallower recessed interstitial spaces 330*f* and thicker walls 348 and 352 can contribute to a larger modulus of elasticity, which can contribute to a more secure fit against the wearer's head. Area 356 having deeper recessed interstitial spaces and a thinner wall (as compared to areas 354 and 358), can contribute to a decreased modulus of elasticity such that the wearer may more easily stretch the band 324*f* over their head, hair, goggles, or other accessories. In some examples, the band 324*f* can be associated with multiple modulus of elasticity values, such that some areas of the band 324*f* stretch more or are more secure than other areas of the band 324*f*, which can contribute to both secure fit and the ability to stretch the cap over one's head. In at least some examples, the terms "shallow" and "deep," "thinner" and "thicker" refer to relative degrees as between areas 354, 356, and 358** or more generally, between surface finishes or between different areas of one surface finish.

In some examples, other portions of the swim cap (e.g., other than the band 324) can include a thinner wall (e.g., the wall associated with the second thickness 336 that is smaller than the first thickness 334), which can be associated with a lower modulus of elasticity (e.g., lower than the modulus associated with the thicker band 324). As such, the thinner wall with the lower modulus of elasticity can more easily stretch to accommodate hair (e.g., longer hair, thicker hair, braided hair, etc.) and/or various head shapes. In some examples, regions associated with a wearer's hair (more superior areas of the cap 310 relative to the edge 314, such as higher up in the crown or apex) have a thinner wall and create a lower modulus of elasticity to allow for stretch to accommodate hair. In some examples, areas with thinner walls can be positioned along the midline of the cap, so as to align with hair that has been pulled back prior to donning the cap. In some examples, regions more proximate to the band (other than the band) have a thicker wall (as compared to the wall associated with more superior regions of the swim cap 310) and create a higher modulus of elasticity to avoid the cap slipping off (as compared to the lower modulus of elasticity of more superior regions of the swim cap 310).

In at least some examples, a swim cap 110, 210, and/or 310 can operate as a base swim cap that is configured to be worn underneath a second swim cap (e.g., underneath an outer swim cap—not illustrated), and the swim cap can include one or more surface finishes on the outer surface configured to improve fit and operability with the outer swim cap. In some examples, a swim cap 110, 210, and/or 310 operating as a base swim cap can interlock with the second outer swim cap by the surface finishes of the base cap interacting with the surface finishes of the second swim cap. In some examples, swim cap 110, 210, and/or 310 may operate as the second outer swim cap and can interlock with the base swim cap by the surface finishes of the base cap interacting with the surface finishes of the second swim cap.

Figure 4A:
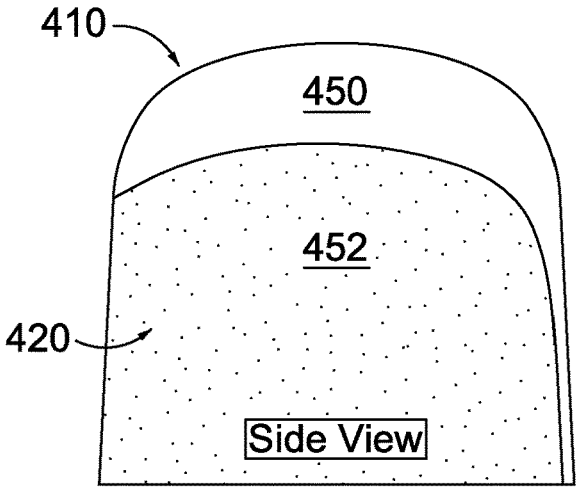
FIG. 4A depicts a side view of another example swim cap, in accordance with examples of this disclosure.
Figure 4B:
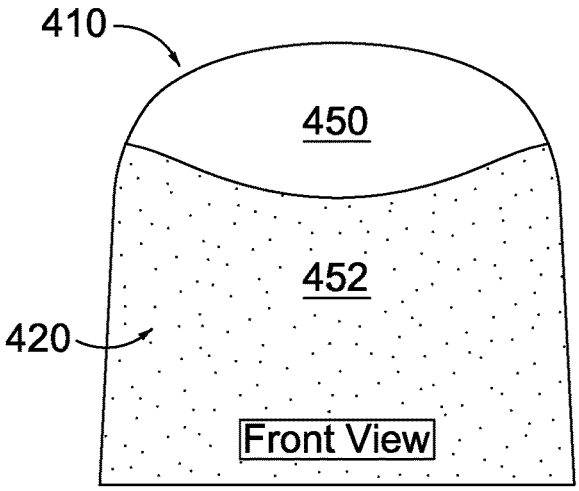
FIG. 4B depicts a front view of the swim cap in FIG. 4A, based on an example.
Figure 4C:
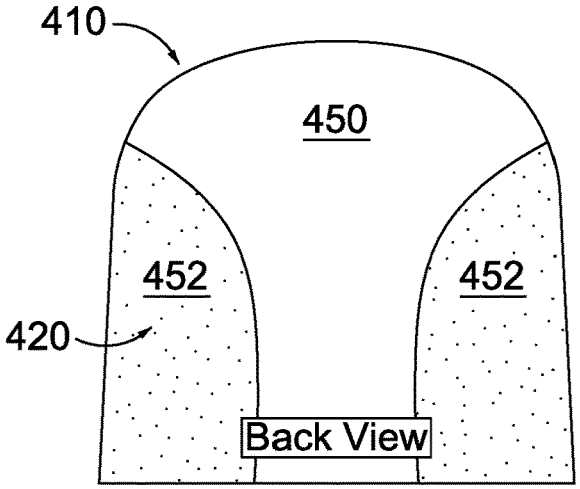
FIG. 4C depicts a back view of the swim cap in FIG. 4A, based on an example.

Referring now to FIGS. 4A-4C, an example swim cap 410 is depicted, and the swim cap 410 comprises an outer face 420 (e.g., configured to face away from the wearer). In examples, the swim cap 410 can include at least some properties similar to the swim cap 110, the swim cap 210, and or the swim cap 310, and for brevity, those same properties are not described again (but it is understood that the same description can apply to the swim cap 410). In examples, the outer face 420 of the swim cap 410 can include one or more regions having different surface finishes. For example, the swim cap 410 is depicted in the different views of FIGS. 4A, 4B, and 4C with one or more first zones 450 associate with a first surface finish and one or more second zones 452 associated with a second surface finish, which is different from the first surface finish. The first surface finish and the second surface finish can vary in one or more respects. For example, the first surface finish and the second surface finish can vary in the smoothness or roughness associated with the respective surfaces (e.g., one surface finish may be of higher-gloss than another). In some examples, the surface finish can comprise a plurality of protuberances that protrude from the outer face (e.g., 120, portion 450, portion 452, etc.) which may take the form of nodules, bumps, ribs, ridges, or raised polygonal shapes. In addition, one surface finish can include a higher-gloss than the other surface finish, which can include a lower gloss finish or a matte finish. In examples, the varied surface finishes can be associated with various operations of the swim cap 410. For example, in some instances, the surface finishes can be configured to affect hydro dynamics (e.g., by reducing drag such as by affecting the boundary layer). In some examples, the outer face (e.g., 120, portion 450, portion 452, etc.) surface finish is associated with a lower coefficient of friction (e.g., lower than conventional swim caps and/or lower than other surfaces of the swim cap). In some examples, the surface finishes can be configured to help retain swim goggles.

Referring now to FIG. 5A-5F, an example swim cap 510 is depicted inside out, and the swim cap 510 comprises an inner face 530 (e.g., configured to face toward the wearer). In examples, the swim cap 510 can include at least some properties similar to the swim cap 110, the swim cap 210, the swim cap 310, and or the swim cap 410, and for brevity, those same properties are not described again (but it is understood that the same description can apply to the swim cap 510). In examples, the inner face 530 of the swim cap 510 can include one or more surface-finish regions 524*a*-524*c* associated with a band 524 having varied properties. For example, in some examples, the regions 524*a*-524*c* are associated with different sizes of surface area that include a respective surface finish. For instance, the size or amount of the surface area can be based on the height of the region covered with a respective surface finish (e.g., where the first region 524*a* is thicker/taller/wider than the third region 524*c*, which is thicker/taller/wider than the second region 524*b*.

Figure 5A:
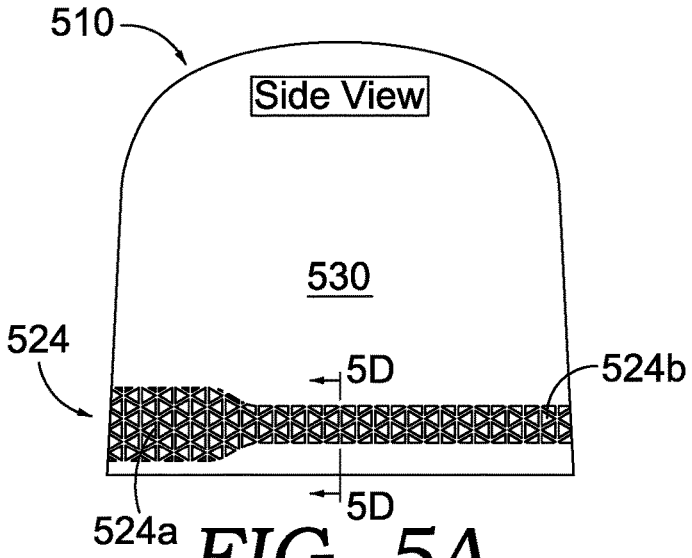
FIG. 5A depicts, with a swim cap inside out, a side view of an example band configuration of a swim cap, in accordance with examples of this disclosure.
Figure 5B:
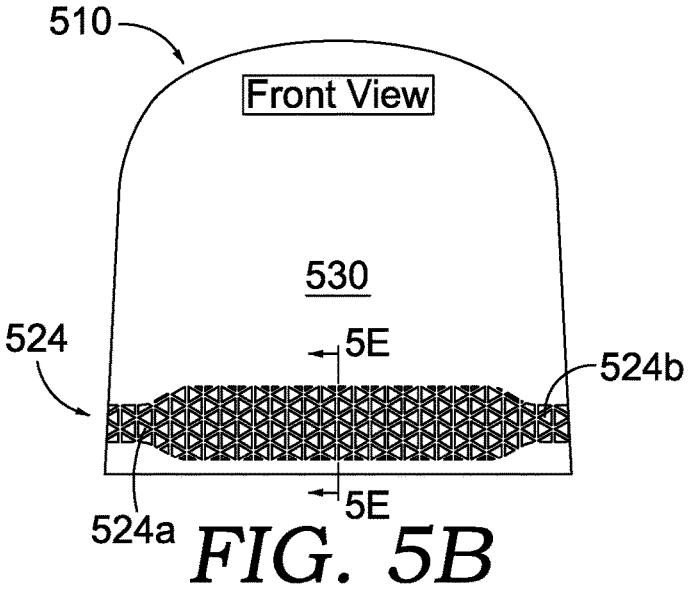
FIG. 5B depicts a front view of the swim cap in FIG. 5A, based on an example.
Figure 5C:
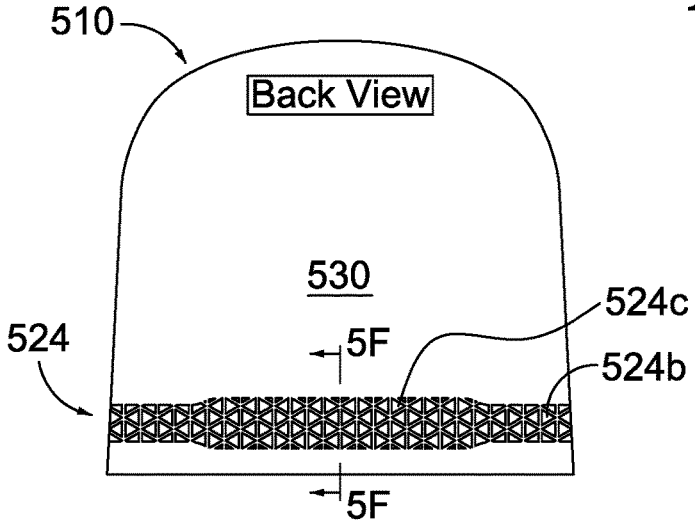
FIG. 5C depicts a back view of the swim cap in FIG. 5A, based on an example.
Figure 5F:
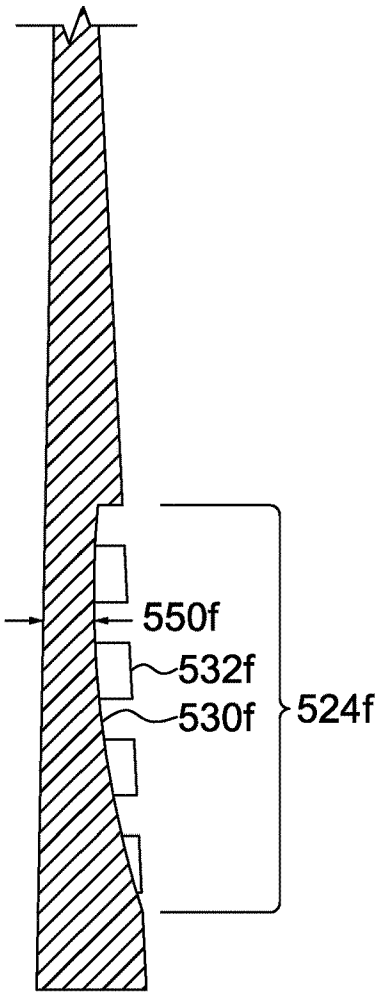
FIG. 5F depicts a cross section of the surface finish of the band in FIG. 5C based on one example.

For example, the swim cap 510 is depicted in the different views of FIGS. 5A, 5B, and 5C with one or more widths associated with the band 524, where the widths are associated with a portion of the band 524 that include the textured surface finish. In some examples, the textured surface finish is associated with a higher coefficient of friction, which can translate to feeling (for the wearer) more "grippy." FIG. 5A depicts a side view of the example swim cap 510, and the side view includes the first region 524*a* including a width 524*e* (FIG. 5E) and a second region 524*b*, which corresponds with a width 524*d* (FIG. 5D). In examples, the first width 524*e* is wider or larger than the second width 524*d*. In some examples, first width 524*e* is associated with the forehead region of the wearer and provides a coefficient of friction (e.g., grippyness) that is conducive to retaining the cap on the wearer (e.g., by not slipping from the forehead). In other examples, first width 524*e* may be associated with other regions of the wearer. In some examples, second width 524*d* is associated with the side head regions of the wearer (e.g., regions associated with ears and/or the side of the head and/or goggle straps) and provides a lower coefficient of friction (as compared to first width 524*e*). In some instances, the lower grip along the sides (based on the second region 524*b*) can improve ear comfort for the wearer. In some examples, the coefficient of friction is the same between first width 524*e* and second width 524*d*. In some examples, first width 524*e* tapers into second width 524*d*, and in other examples, there is no tapering between the two widths.

FIG. 5B depicts a front view of example swim cap 510 associated with the first width 524*e* associated with the forehead region of the wearer and configured to provide a surface with a higher coefficient of friction to avoid slipping off the wearer's forehead and a second width 524*d* associated with the side head regions of the wearer. In other examples, first width 524*e* and second width 524*d* may be associated with other regions of the wearer. In some examples, first width 524*e* is thicker or larger than second width 524*d*. In some examples, first width 524*e* tapers into second width 524*d*, and in other examples, there is no tapering between the widths.

FIG. 5C depicts a back view of example swim cap 510, including the third region 524*c* of the band 524, and is associated with the second width 524*d* and third width 524*f* (FIG. 5F), the third width 524*f* being wider than second width 524*d*. In some examples, the third region 524*c* and the third width 524*f* is associated with a neck region of the wearer and provides a degree of surface friction conducive to avoid slipping off the neck region of the wearer. In some examples, third width 524*f* may be the same width as first width 524*e* or it may be different. In some examples, the properties are the same or similar between first width 524*e*, second width 524*d*, and third width 524*f*. In some examples, third width 524*f* tapers into second width 524*d*, and in other examples, there is no tapering between the widths.

As indicated above, the band 524 can have various surface finishes associated with the first region 524*a*, second region 524*b*, and third region 524*c*. In some examples, the band 524 can be associated with a plurality of wall thicknesses corresponding to first region 524*a*, second region 524*b*, and third region 524*c* such as where a surface finish includes a pattern of protuberances. For example, referring to FIG. 5D-5F, cross sectional views are depicted of different embodiments, taken along the respective cross-reference lines in FIGS. 5D-5F.

Referring to FIG. 5D, second width 524*d* associated with the second region 524*b* can be associated with protuberances (e.g. 532*d*) and interstitial spaces (e.g., 530*d*). In some examples, at least a portion of the second width 524*d* associated with the second region 524*b* is associated with the cross section shown in FIG. 5D. In some examples, the second width 524*d* associated with the second region 524*b* has shallower interstitial spaces 530*d* (as compared to the interstitial spaces in FIG. 5E and FIG. 5F) and correspond with a first wall thickness 550*d*. In some examples, the second width 524*d* associated with the second region 524*b* is associated with a plurality of wall thicknesses. In some examples, the first wall thickness 550*d* is similar to the wall thickness in the other regions.

Figure 5E:
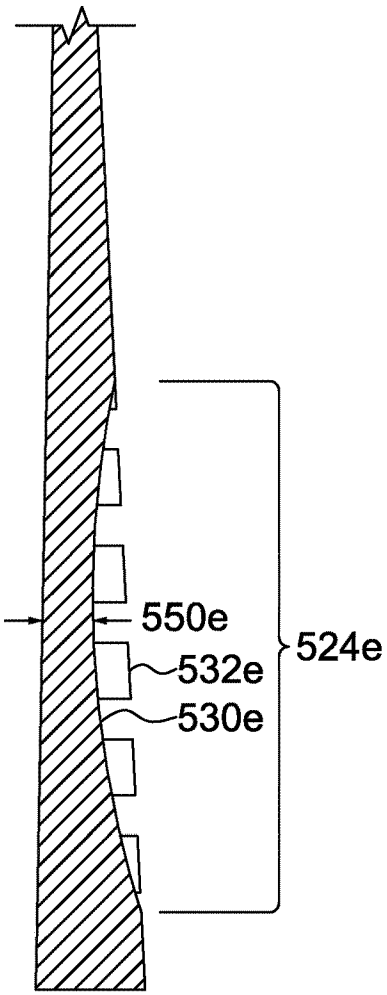
FIG. 5E depicts a cross section of the surface finish of the band in FIG. 5B based on one example.
Figure 5D:
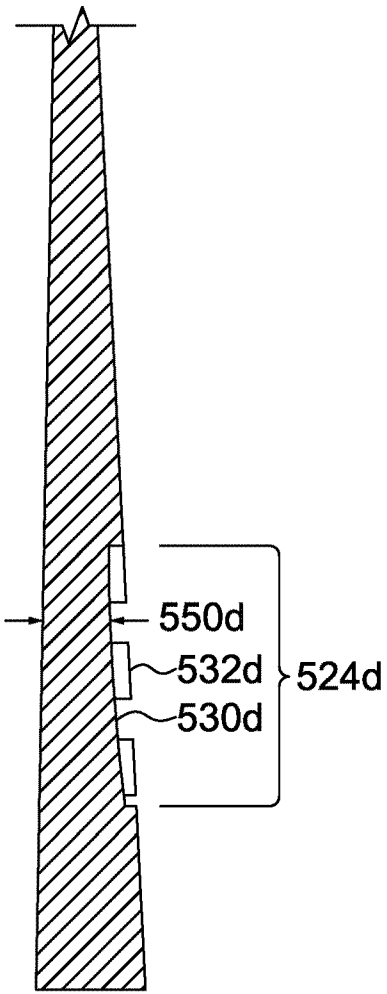
FIG. 5D depicts a cross section of the surface finish of the band in FIG. 5A based on one example.

Referring to FIG. 5E, first width 524*e* associated with the first region 524*a* has deeper interstitial spaces 530*e* (as compared to the interstitial spaces in FIG. 5D) and corresponds with a second wall thickness 550*e*. In some examples, first wall thickness 550*d* is thinner than second wall thickness 550*e*, and in other examples, first wall thickness 550*d* and second wall thickness 550*e* are the same. In some examples, the first width 524*e* associated with the first region 524*a* has interstitial spaces 530*e* of the same depth (as compared to the interstitial spaces in FIG. 5D and FIG. 5F) and in other examples, the first region 524*a* has interstitial spaces 530*e* of different depths (as compared to the interstitial spaces in FIGS. 5D and 5F). In some examples, the first width 524*e* associated with the first region 524*a* is associated with a plurality of wall thicknesses.

Referring to FIG. 5F, the third width 524*f* associated with the third region 524*c* has deeper interstitial spaces 530*f* (as compared to the interstitial spaces in FIG. 5D) and corresponds with a third wall thickness 550*f*. In some examples, the first wall thickness 550*d*, second wall thickness 550*e*, and the third wall thickness 550*f* are the same, and in other examples, third wall thickness 550*f* is different from second wall thickness 550*e* and first wall thickness 550*d*, or a combination thereof. For example, third wall thickness 550*f* may be thinner than second wall thickness 550*e*. In some examples, the third width 524*f* associated with the third region 524*c* is associated with a plurality of wall thicknesses.

Figure 6:
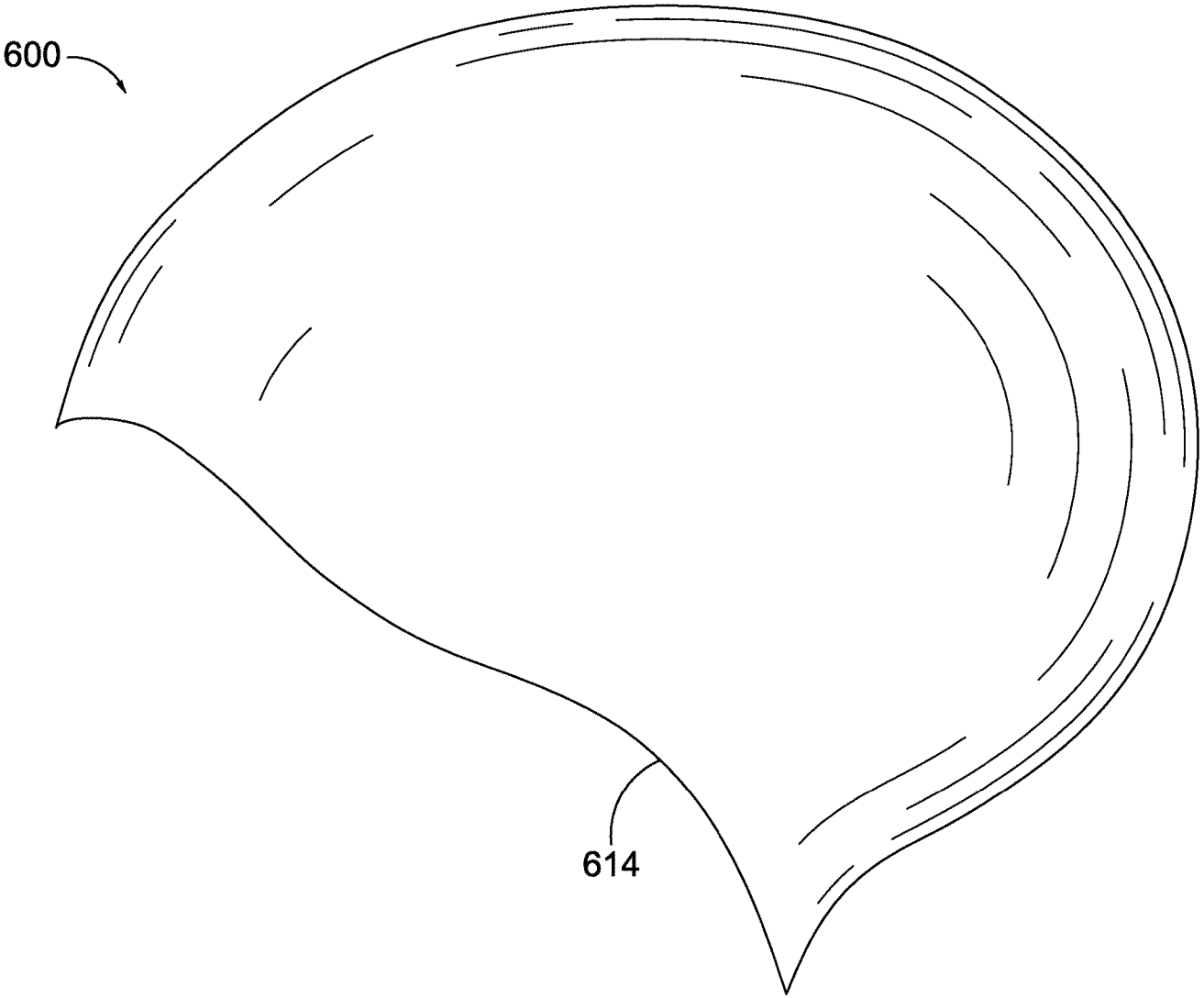
FIG. 6 depicts a side view of an example swim cap, in accordance with examples of this disclosure.

Referring now to FIG. 6, an example swim cap 600 is depicted having a wall configured to form around a human head. In examples, the swim cap 600 can include at least some properties similar to the swim cap 110, the swim cap 210, the swim cap 310, the swim cap 410, and/or the swim cap 510 and for brevity, those same properties are not described again (but it is understood that the same description can apply to the swim cap 600). In some examples, the terminal edge 614 of the swim cap 600 forms contours around the forehead, ears, or neck. For example, swim cap 600 includes a concave contour along the terminal edge 614. In other examples, the contour may be convex. In some examples, the portion of the swim cap 600 associated with containing the user's hair may be oblong such that hair may easily fit inside. For example, swim cap 600 may be formed in a shape corresponding to a human head with hair contained at the superior or apex region of the head. In other examples, the swim cap is dome shaped and may not have contours around the forehead, ears, and neck.

Figure 7:
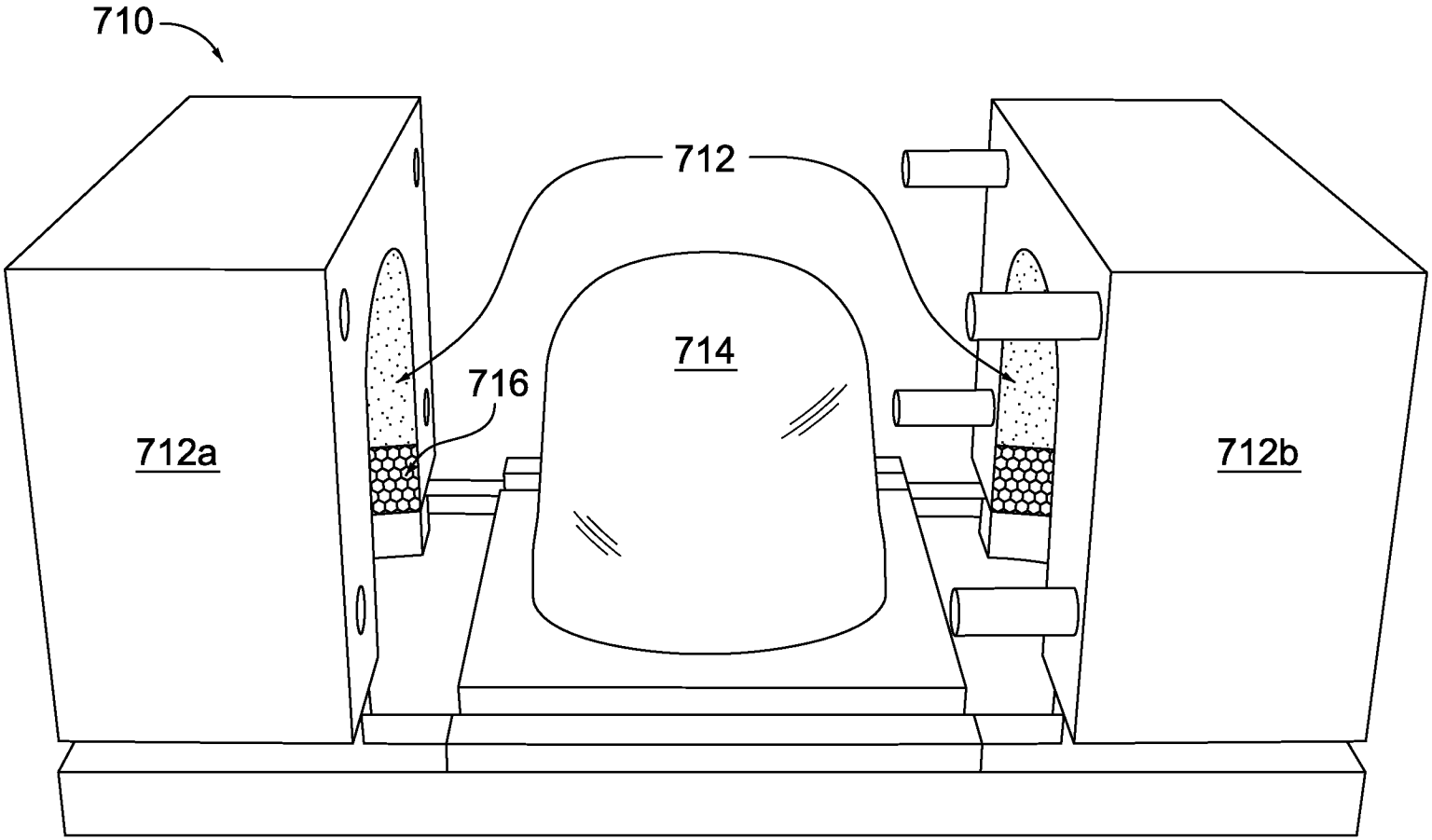
FIG. 7 depicts a mold for forming a swim cap, in accordance with examples of this disclosure.

A swim cap (e.g., the swim cap(s) 110, 210, 310, 510, and 600) can be constructed using various approaches. Referring to FIG. 7, in at least some examples, a swim cap can be molded using a mold 710 having a cavity 712 and a core 714 (e.g., domal core). For example, the cavity 712 can include a two-part cavity having a first part 712*a* and a second part 712*b* that can be moved together (e.g., slid together such that the pins on the second part 712*b* insert into the recesses on the first part 712*a*) to enclose a space between the core 714 and the cavity 712. A material (e.g., silicone) can then be injected into the space between the core 714 and the closed cavity 712 to form a swim cap.

In examples, a swim cap can be molded inside out, such that the outer face (e.g., 120, portion 450, portion 452, etc.) is oriented towards the core 714 and the inner face (e.g., 118, 218, 318, and 530) is oriented towards the cavity 712. As such, the surface of the core 714 can be configured to impart one or more surface finishes on the outer face (e.g., 120, portion 450, portion 452, etc.) of the swim cap, and the surface of the cavity 712 can be configured to impart one or more surface finishes on the inner face (e.g., 118, 218, 318, and 530) of the swim cap. For example, where a high-gloss surface finish is desired in association a face of the swim cap, the corresponding surface of the core and/or the cavity can include a high-gloss surface (e.g., smoother surface). In some examples, where a matte finish is desired, the cavity and/or the core can include a rougher surface. In some examples, where one or more finishes is desired in association with a face of the swim cap, the cavity and/or the core can include both regions with high-gloss surface and regions with less high-gloss surfaces. For example, the core 714 can include regions that correspond with the regions 450 and 452 and that are configured to impart a desired surface finish (e.g., higher-gloss to impart a smoother surface and rougher to impart a more matte finish).

In some examples, a band 716 extending around a lower margin of the cavity 712 (e.g., along the lower margin of both the first part 712*a* and the second part 712*b*) can be configured to impart one or more surface finishes (e.g., 130, 230, 232, etc.) on the band (e.g., 124, 324, 524) of the swim cap. In some examples, the band 716 can include debossed cavities configured to form the raised protuberances, for example raised nodules 130, and/or the band 716 can include a pattern of smoother and rougher surfaces to form corresponding high-gloss and matte surface finishes (e.g., corresponding with 230 and 232). Furthermore, in some examples, the band 716 can be recessed into the surface of the cavity 712, such that a swim-cap band (e.g., 324) molded via the corresponding cavity band 716 can include a first wall thickness (e.g., 334) that is thicker than other walls of the of the swim cap. That is, when the cavity sides are closed, the space between the band 716 and the core 714 can be wider than the space between other regions of the cavity 712 and the core 714.

Clauses

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

Clause 1. A swim cap comprising: a wall at least partially enclosing a volume; the wall comprising an inner face facing towards the volume; a terminal edge forming a boundary around an opening to the volume; the inner face comprising a first region associated with a first surface finish; and the inner face comprising a second region that is more proximate, as compared to the first region, to the terminal edge and that is associated with a second surface finish, which is different from the first surface finish.

Clause 2. The swim cap of clause 1, wherein the first surface finish comprises a lower-gloss than the second surface finish.

Clause 3. The swim cap of clauses 1 or 2, wherein the second surface finish, as compared to the first surface finish, comprises a higher coefficient of friction.

Clause 4. The swim cap of any of clauses 1 through 3, wherein the wall compositionally comprises silicone.

Clause 5. The swim cap of any of clauses 1 through 4, wherein the second surface finish comprises a plurality of high-gloss surfaces and a plurality of low-gloss surfaces that are not raised.

Clause 6. The swim cap of any of clauses 1 through 5, wherein the plurality of high-gloss surfaces and the plurality of low-gloss surfaces are polygonal shapes.

Clause 7. The swim cap of any of clauses 1 through 5, wherein the plurality of high-gloss surfaces and the plurality of low gloss surfaces are irregular shapes.

Clause 8. The swim cap of clauses 6 or 7, wherein the plurality of high gloss surfaces and the plurality of low gloss surfaces are arranged in a pattern.

Clause 9. The swim cap of clauses 6 or 7, wherein the plurality of high gloss surfaces and the plurality of low gloss surfaces are arranged irregularly.

Clause 10. The swim cap of any of clauses 1 through 4, wherein the second surface finish comprises a plurality of raised protuberances and recessed interstitial regions.

Clause 11. The swim cap of clause 10, wherein a surface of the raised protuberances is higher gloss and a surface of the recessed interstitial spaces is lower gloss.

Clause 12. The swim cap of any of clauses 1 through 11, wherein at least a portion of the second region comprises a first wall thickness, which is thicker than a second thickness associated with one or more other regions of the wall.

Clause 13. The swim cap of any of clauses 1 through 12, wherein the wall comprises a tapered portion that gradually transitions in thickness from the first wall thickness to the second wall thickness.

Clause 14. The swim cap of any of clauses 10 through 13, wherein: the swim cap further comprises a band circumferentially extending around the opening and comprising the plurality of raised protuberances and recessed interstitial spaces; a portion of the wall is associated with the band and comprises a first wall thickness associated with a first interstitial space and a second wall thickness associated with a second interstitial space; and the first wall thickness is different from the second wall thickness.

Clause 15. The swim cap of any of clauses 10 through 14, wherein the raised protuberances comprise a polygonal shape.

Clause 16. The swim cap of any of clauses 10 through 14, wherein the raised protuberances comprise irregular shapes.

Clause 17. The swim cap of clauses 15 or 16, wherein the raised protuberances and recessed interstitial spaces are arranged in a pattern.

Clause 18. The swim cap of clauses 15 or 16, wherein the raised protuberances and recessed interstitial spaces are arranged irregularly.

Clause 19. The swim cap of any of clauses 1 through 18, wherein the wall comprises an outer face comprising a third region associated with a third surface finish and a fourth region associated with a fourth surface finish, which is different from the third surface finish.

Clause 20. The swim cap of clause 19, wherein the third surface finish comprises a higher gloss than the fourth surface finish.

Clause 21. A swim cap comprising: a wall at least partially enclosing a volume; the wall comprising an inner face facing towards the volume; a terminal edge forming a boundary around an opening to the volume; the inner face comprising a first region associated with a first surface finish; the inner face comprising a second region that is more proximate, as compared to the first region, to the terminal edge and that is associated with a second surface finish, which is different from the first surface finish, the second surface finish comprising a plurality of raised protuberances and recessed interstitial spaces; and the recessed interstitial spaces associated with a first wall thickness and a second wall thickness, which is different than the first wall thickness.

Clause 22. The swim cap of clause 21, wherein the first surface finish comprises, as compared to the plurality of raised protuberances, a lower gloss surface finish.

Clause 23. The swim cap of clauses 21 or 22, wherein the plurality of raised protuberances comprise, as compared to the recessed interstitial spaces, a higher gloss surface finish.

Clause 24. The swim cap of clauses 21 or 22, wherein the plurality of raised protuberances comprise, as compared to the recessed interstitial spaces, a lower gloss surface finish.

Clause 25. A mold configured to form a swim cap, the mold comprising: a domal core comprising a first surface finish; a cavity comprising a second surface finish, which is different from the first surface finish; and the cavity comprising, in association with a lower margin of the cavity, a band comprising a third surface finish.

Clause 26. The mold of clause 25, wherein the band is recessed into a surface of the cavity, such that a space between the band and the domal core is larger than a space between other regions of the cavity and the domal core.

Clause 27. The mold of clauses 25 or 26, wherein the band comprises debossed cavities.

Clause 28. The mold of any of clauses 25 through 27, wherein the band comprises a pattern of higher gloss and lower gloss surfaces.

Clause 29. The mold of any of clauses 25 through 28, wherein the domal core and the first surface finish are configured to form an outer face of the swim cap and the cavity and the second surface finish are configured to form an inner face of the swim cap.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

The invention claimed is:

1. A swim cap comprising:

a wall at least partially enclosing a volume;

the wall comprising an inner face facing towards the volume;

a terminal edge forming a boundary around an opening to the volume;

the inner face comprising a first region associated with a first surface finish; and the inner face comprising a second region that is more proximate, as compared to the first region, to the terminal edge and that is associated with a second surface finish, wherein the second surface finish comprises a higher gloss than the first surface finish, wherein a first location along a circumference of the second region comprises a first height of the second surface finish and wherein a second location along the circumference of the second region comprises a second height of the second surface finish, and wherein the first height is taller than the second height;

wherein a thickness of the wall at the terminal edge is thicker than a thickness of the wall at the first region.

2. The swim cap of claim 1, wherein the second surface finish, as compared to the first surface finish, comprises a higher coefficient of friction.

3. The swim cap of claim 1, wherein the wall compositionally comprises silicone.

4. The swim cap of claim 1, wherein the second surface finish comprises a plurality of raised protuberances and recessed interstitial regions.

5. The swim cap of claim 4, wherein a surface of the raised protuberances is higher gloss and a surface of the recessed interstitial regions is lower gloss.

6. The swim cap of claim 4, wherein at least a portion of the second region comprises a first wall thickness, which is thicker than a second wall thickness associated with one or more other regions of the wall.

7. The swim cap of claim 6, wherein the wall comprises a tapered portion that gradually transitions in thickness from the first wall thickness to the second wall thickness.

8. The swim cap of claim 4, wherein:

the swim cap further comprises a band circumferentially extending around the opening and comprising the plurality of raised protuberances and recessed interstitial spaces;

a portion of the wall is associated with the band and comprises a first wall thickness associated with a first interstitial space and a second wall thickness associated with a second interstitial space; and the first wall thickness is different from the second wall thickness.

9. The swim cap of claim 4, wherein the raised protuberances comprise a polygonal shape.

10. The swim cap of claim 1, wherein the wall comprises an outer face comprising a third region associated with a third surface finish and a fourth region associated with a fourth surface finish, which is different from the third surface finish.

11. The swim cap of claim 10, wherein the third surface finish comprises a higher gloss than the fourth surface finish.

12. A swim cap comprising:

a wall at least partially enclosing a volume;

the wall comprising an inner face facing towards the volume;

a terminal edge forming a boundary around an opening to the volume;

the inner face comprising a first region associated with a first surface finish;

the inner face comprising a second region that is more proximate, as compared to the first region, to the terminal edge and that is associated with a second surface finish, which is different from the first surface finish, the second surface finish comprising a plurality of raised protuberances and recessed interstitial spaces, wherein the first surface finish comprises, as compared to the plurality of raised protuberances, a lower gloss finish, and the recessed interstitial spaces associated with a first wall thickness in a first area of the second region, a second wall thickness in a second area of the second region, and a third wall thickness in a third area of the second region, wherein the second area is positioned above the first area and below the third area, and wherein the second wall thickness is smaller than the first wall thickness and the third wall thickness;

wherein a thickness of the wall at the terminal edge is thicker than a thickness of the wall at the first region.

13. The swim cap of claim 12, wherein each of the first surface finish and the second surface finish comprise a surface texture, a material deposit applied to a surface, or a combination thereof.

14. The swim cap of claim 12, wherein the plurality of raised protuberances comprise, as compared to the recessed interstitial spaces, a higher gloss surface finish.

* * * * *